US006131780A

United States Patent [19]

Becker

[11] Patent Number: 6,131,780

[45] Date of Patent: Oct. 17, 2000

[54] BOTTLE TOTE

[76] Inventor: Elsie Clare Becker, 4756 Luther Ave., North Port, Fla. 34287

[21] Appl. No.: 09/337,005

[22] Filed: Jun. 28, 1999

[51] Int. Cl.[7] ..... A45F 5/00

[52] U.S. Cl. ..... 224/148.6; 224/250; 224/269; 224/650; D3/229; 294/150

[58] Field of Search ..... 224/250, 148.1, 224/148.5, 148.6, 221, 269, 650; D3/229; 294/149, 150

[56] References Cited

U.S. PATENT DOCUMENTS

| | | | |
|---|---|---|---|
| 1,605,195 | 11/1926 | Lewis | 224/148.6 |
| 3,543,976 | 12/1970 | Ronald | 224/148.6 |
| 3,600,734 | 8/1971 | Pollinger | 224/250 X |
| 4,762,257 | 8/1988 | Spillers et al. | 224/250 X |
| 4,796,790 | 1/1989 | Hamilton | 224/250 X |
| 5,427,291 | 6/1995 | Smith | 224/250 |
| 5,622,346 | 4/1997 | Story, Jr. | 224/250 X |
| 5,664,712 | 9/1997 | Smrt | 224/250 |
| 5,806,730 | 9/1998 | Deno | 224/250 X |
| 5,820,000 | 10/1998 | Timberlake et al. | 224/221 X |
| 5,855,306 | 1/1999 | Masek | 224/250 |
| 6,029,870 | 2/2000 | Giacona, III | 224/148.6 |

*Primary Examiner*—Gregory M. Vidovich
*Attorney, Agent, or Firm*—Frank A. Lukasik

[57] ABSTRACT

A device for carrying a bottle of liquid consisting of a length of nylon webbing belt with an assembly of nylon cord and a spring loaded toggle clip attached. The nylon cord is placed over a bottle neck and the length of the cord surrounding the bottle neck is adjusted by sliding the toggle clip up to a point touching and holding the bottle.

1 Claim, 10 Drawing Sheets

BOTTLE TOTE

BACKGROUND OF THE INVENTION

1. Field of the Invention

This invention relates generally to a bottle carrier and more particularly to a device for carrying any size bottle, over the shoulder, strapped to luggage, clipped to an object, and many other items.

2. Background of the Invention

Bottled drinks have become a commodity which has become very popular for outdoor events and other events which last for long periods and where drinking water is not readily available or is of questionable quality. In addition, tennis players and other athletes, often fill an empty soda battle, freeze it, and then carry the bottle to the sporting event. Golf fans following their favorite pros along the golf course can often be seen carrying a bottle of mineral water as they walk along the fairways. Each of the above uses require holding the bottle in their hands. In the case of the bottle of ice water, it is uncomfortable to carry and begins to thaw because of the body heat of the user. The frozen bottle may also be carried in a tennis bag, however, the condensation collecting on the outside of the bottle will wet anything being carried in the tennis bag.

In addition to carrying bottles of water, sports fans may wish to carry full bottles of soda. In the case of a bottle of soda, it is more important not to hold the bottle in the hands because of the effect of body temperature on the carbonation of the soda and the resulting foam and loss of pressure in the bottle. Baby bottles are often dropped by the baby and become unsanitary. What is needed is some type of holder, or handle, to conveniently carry the bottle without spilling or warming the contents.

SUMMARY OF THE INVENTION

The invention is a simple device which allows a person to carry multiple size bottle tops over the shoulder, or clipped to any object or item, thus freeing the hands for other activities. The bottle tote is a length of nylon web strapping belt with cording and jacket cord clips attached at one end to provide an adjustable opening for a bottle and to provide a snug fit on a bottle neck. The belt has a loop formed at one end with the cording assembled within the loop. The cording is threaded through a hole in the jacket cord clip and each end of the cording is knotted to prevent the clip from being removed. A swivel top "J" clip may be stitched to the other end of the strapping belt to fasten to a "D" loop at the loop end to form a convenient carrying loop or to fasten to an object such as the hand rail of a baby stroller.

The belt loop is placed against the top neck of the bottle, the cord is placed around the neck, and the cord is drawn taut through the clip to hold the bottle head in place. The cord is then used as a strap to carry the bottle or fasten to any other portable carrier.

DESCRIPTION OF THE PREFERRED EMBODIMENT

Figure 1:
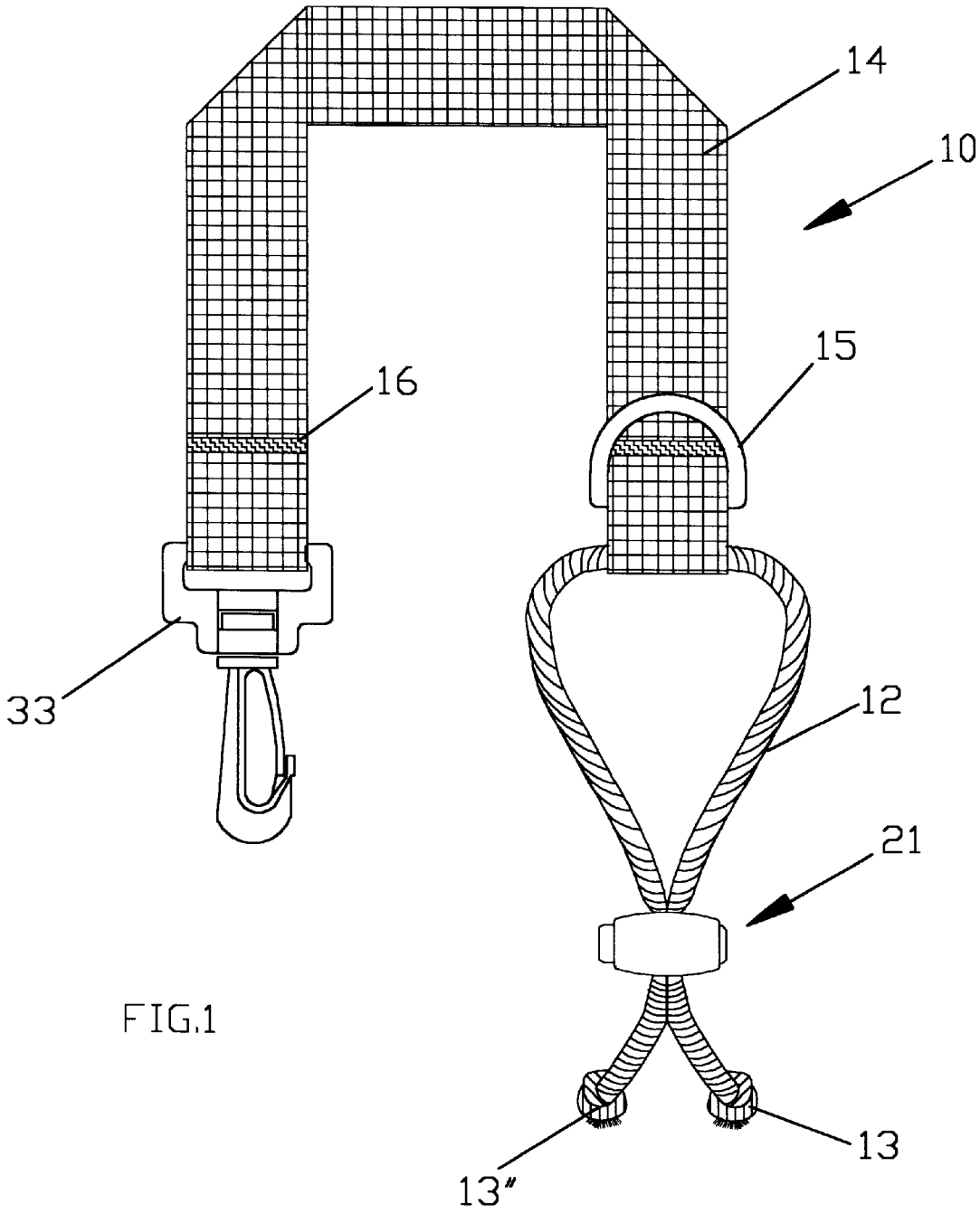
FIG. 1 is a front view of a bottle tote in accordance with the invention.

Referring to FIG. 1, there is shown the bottle tote of the invention denoted generally by the numeral 10. A first embodiment of the bottle tote 10 is shown in FIG. 1. The common elements on the bottle tote 10 of the invention are shown as nylon webbing belt 14, braided nylon cord 12, spring loaded (jacket cord clip) toggle clip 21, knotted ends 13 and 13' and zig-zag stitching 16.

Figure 8:
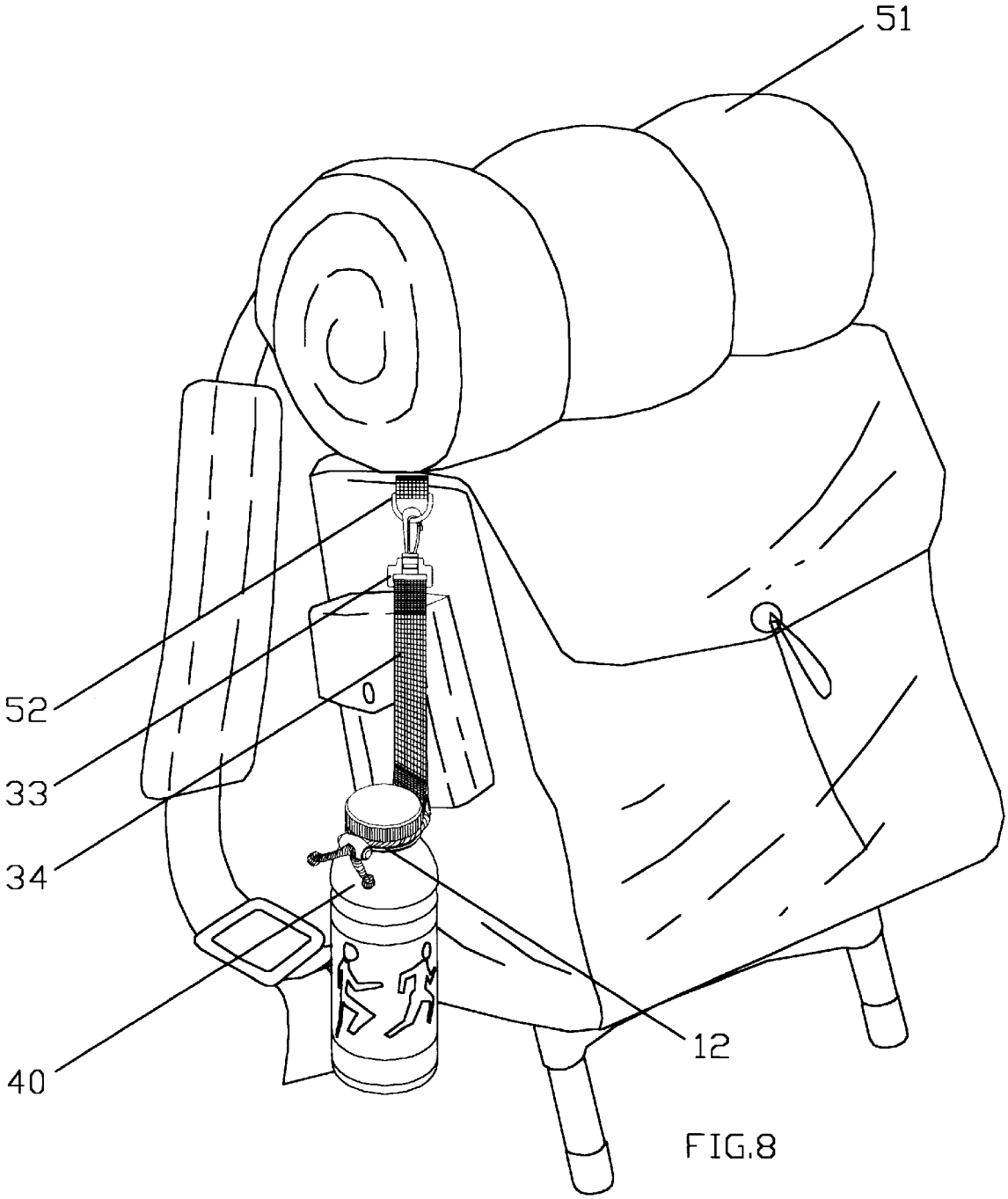
FIG. 8 is a top perspective view of a bottle tote attached to a knapsack in accordance with the invention.

In FIG. 1, these elements have been combined with the addition of plastic "J" clip 33 which facilitates the attachment of the bottle tote 10 to a suitable site such as "D" ring 52 on back pack 51 as shown in FIG. 8 or the "D" ring 15 shown in FIG. 1. The "J" clip 33 is attached at a first end of webbing belt 14 and a "D" ring 15 and nylon cord 12 loop is attached to the second end. The nylon cord 12 has knots 13 and 13' to prevent fraying and to act as stops to retain the toggle clip 21 in place. The toggle clip 21 being slidably attached to the nylon cord 12 as an adjustment means over the tail ends, knots 13 and 13' of nylon cord 12. The length of the nylon cord 12 is sized to fit the largest bottles currently on the market (2 liters-67.6 FL. OZ) (2 quarts 3.6 OZ) to a small size bottle of wine (187 ml.). Cord 12 is fit under the top of the bottles, where it is drawn into gripping contact by cord 12 as it is gradually drawn through the hole 24 of toggle clip 21.

Figure 2:
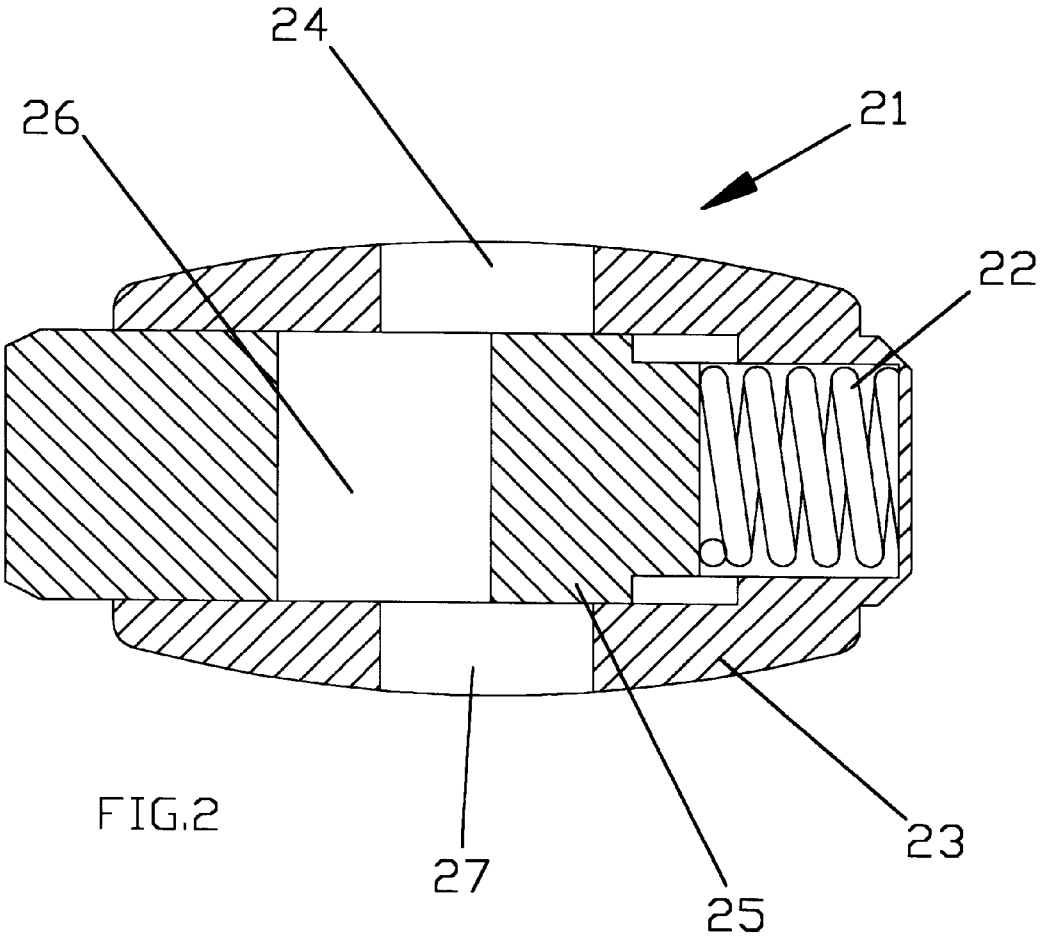
FIG. 2 is a side, sectional view of the jacket cord clip in accordance with the invention.

FIG. 2 is a sectional view of a spring loaded toggle clip 21 of the type commonly found as an adjustment for the necks and waists of jackets, wherein the cords 12 are threaded through the top hole 24, through the hole 26 in slide 25 and out through hole 27. Spring 22 displaces slide 25 such that the cord 12 is pinched, thus fixing spring loaded toggle clip 21 at that location. The simple expedient of knotting the ends of braided nylon cord 12, limits the range which spring loaded toggle clip 21 can travel along the cord 21.

Figure 3:
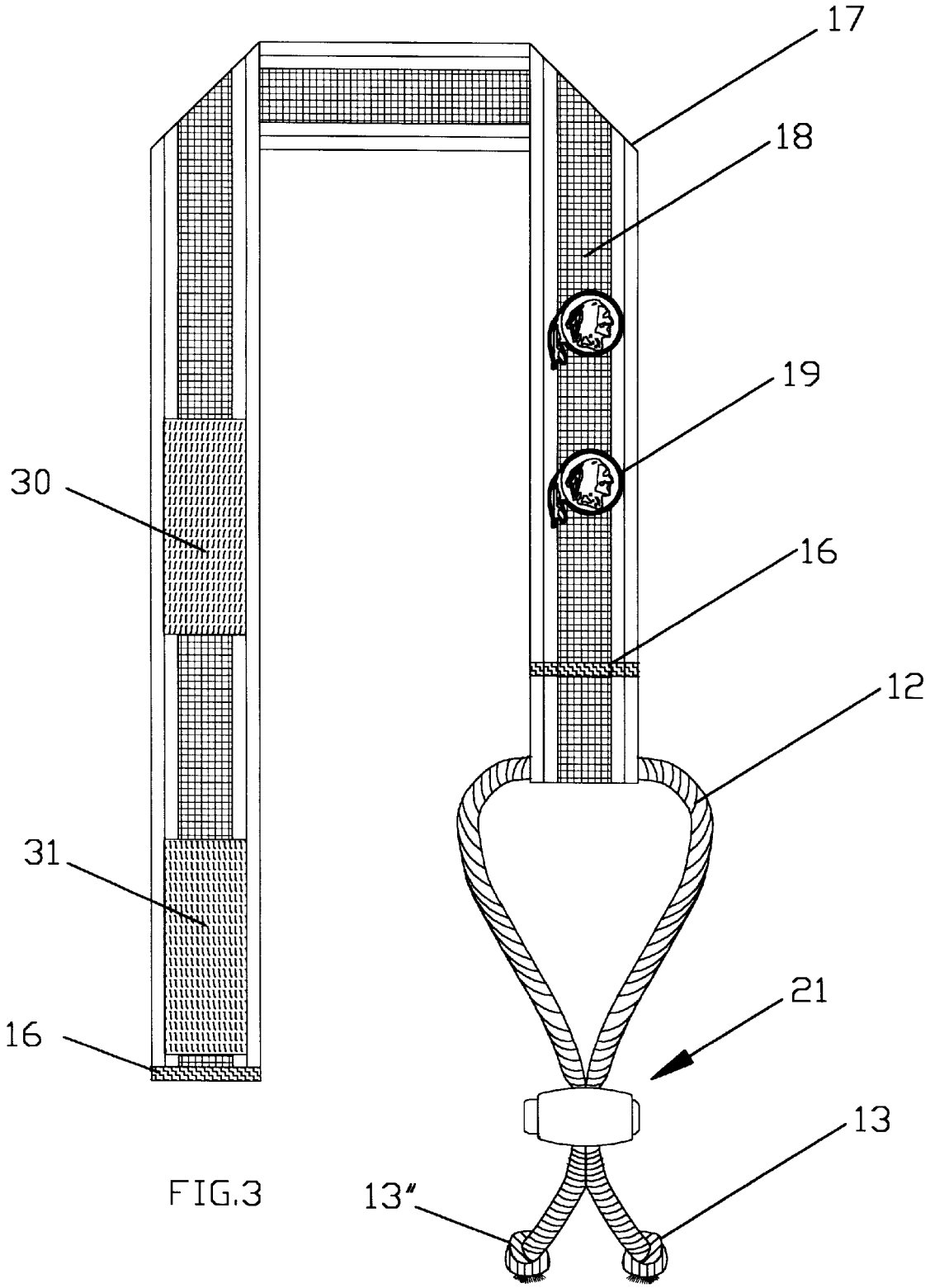
FIG. 3 is a front view of a second embodiment of a bottle tote in accordance with the invention.

Bottle tote 10, because of its wide, flat surface of nylon webbing belt 14, provides an ideal surface for the placement of corporate advertising shown as an example in FIG. 3 where sports logo 19 is imprinted, woven in or otherwise affixed. Similarly, brand names or trade marks or otherwise licensed or registered marks or colors can be incorporated into the weave of belt 14 or continued as a theme by using appropriate colors for cord 12 and spring loaded toggle clip 21.

Figure 5:
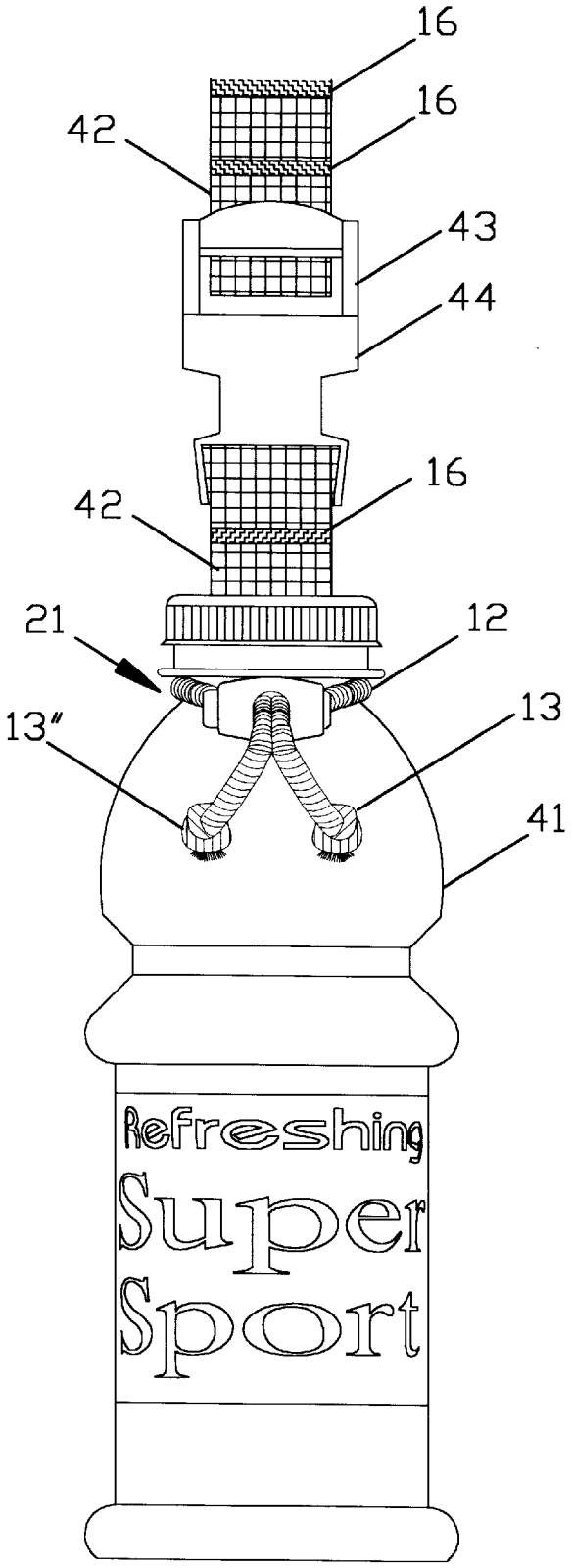
FIG. 5 is a front view of a third embodiment of a bottle tote attached to a bottle neck.
Figure 6:
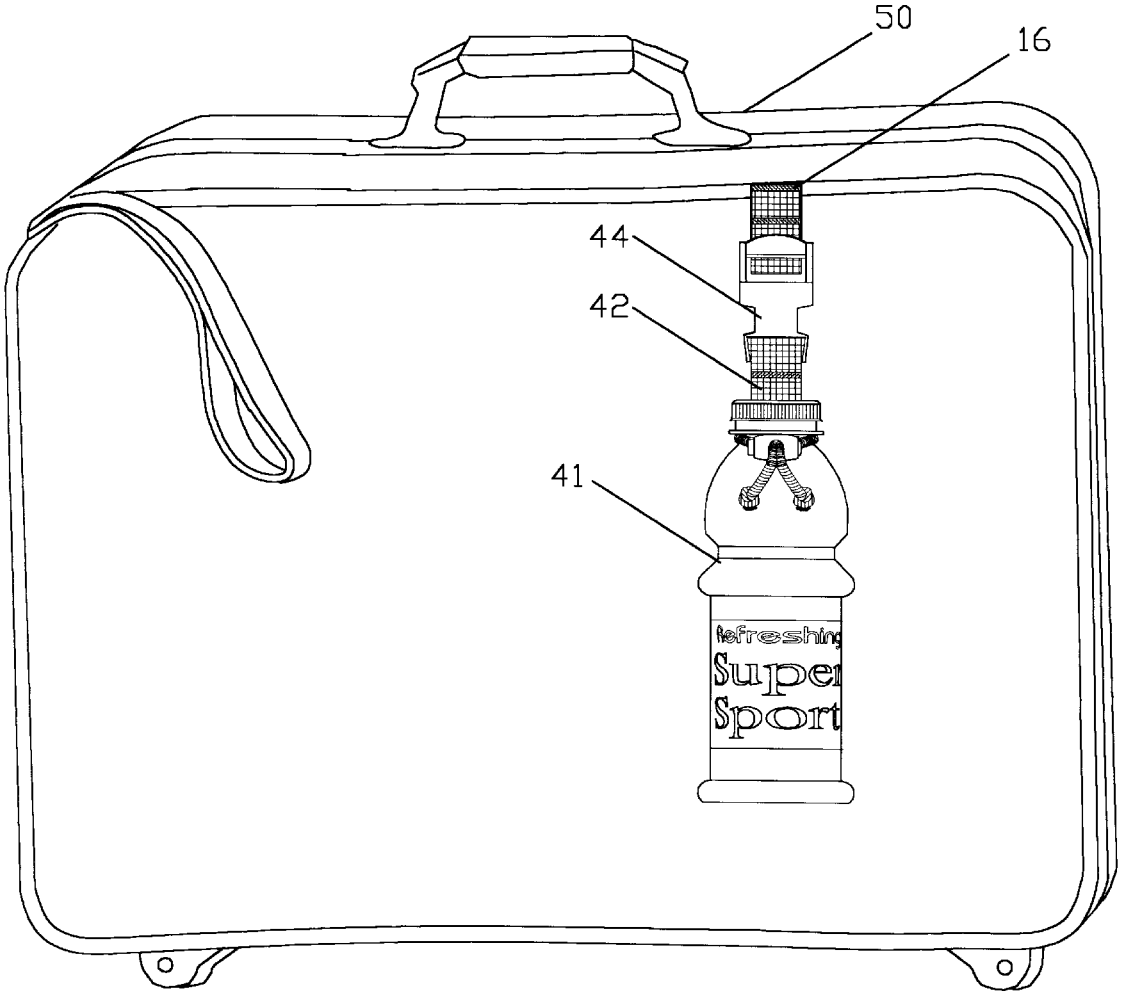
FIG. 6 shows the bottle tote attached to a travel suitcase in accordance with the invention.
Figure 7:
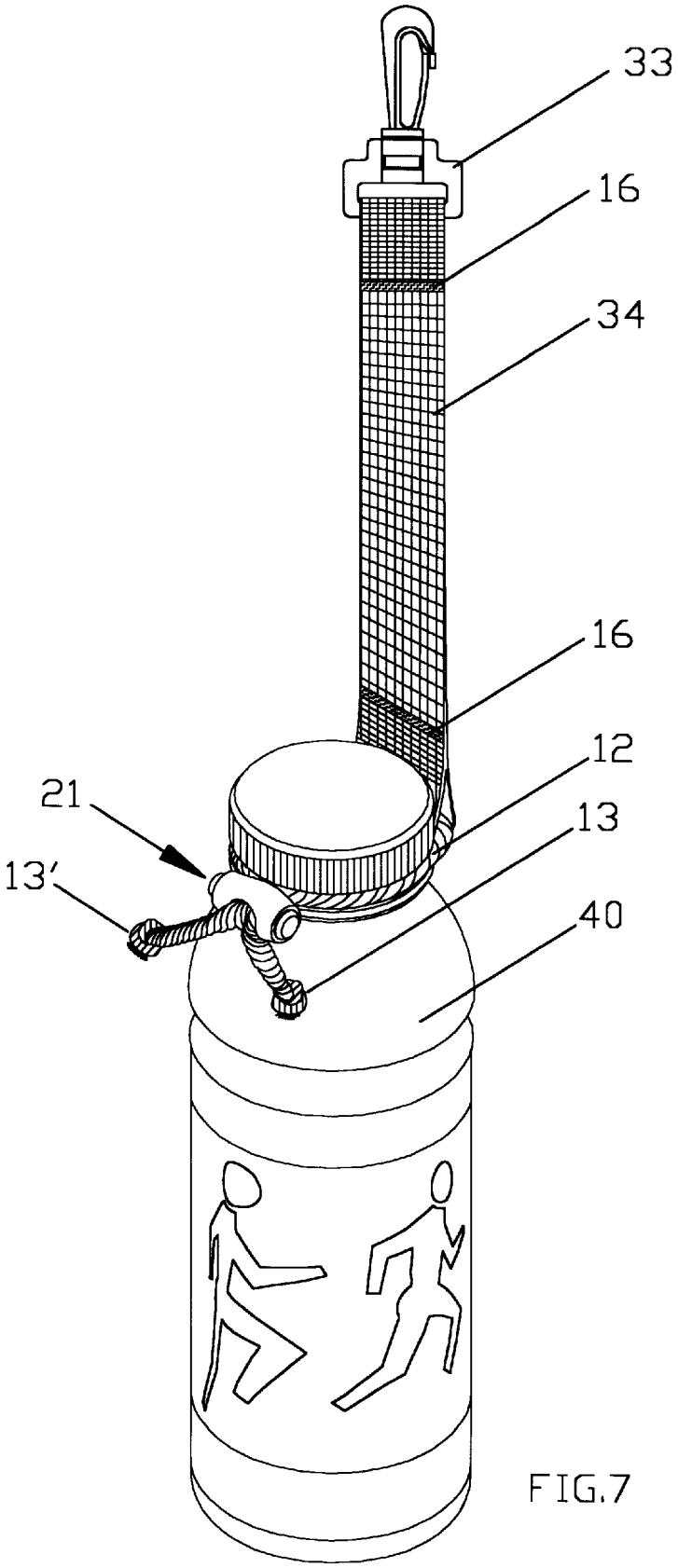
FIG. 7 is a top perspective view of a bottle tote attached around a plastic container in accordance with the invention.

Referring now to FIGS. 4–11, the basic concepts of bottle tote 10 are combined in various ways to show, for example, the inclusion of a plastic snap clip 43, 44, as a connection/disconnection means. The inclusion of the plastic snap clip 43, 44 facilitates the permanent attachment of bottle tote 10 to suitcases, etc., while allowing the rapid removal of plastic bottle 41 for use as a refreshment means or for refilling or replacement. Similarly, FIGS. 7–8 show a further application wherein bottle tote 10 is temporarily affixed by a "J" clip 33 to a hiker's backpack 51 thereby freeing hands for other tasks.

Figure 11:
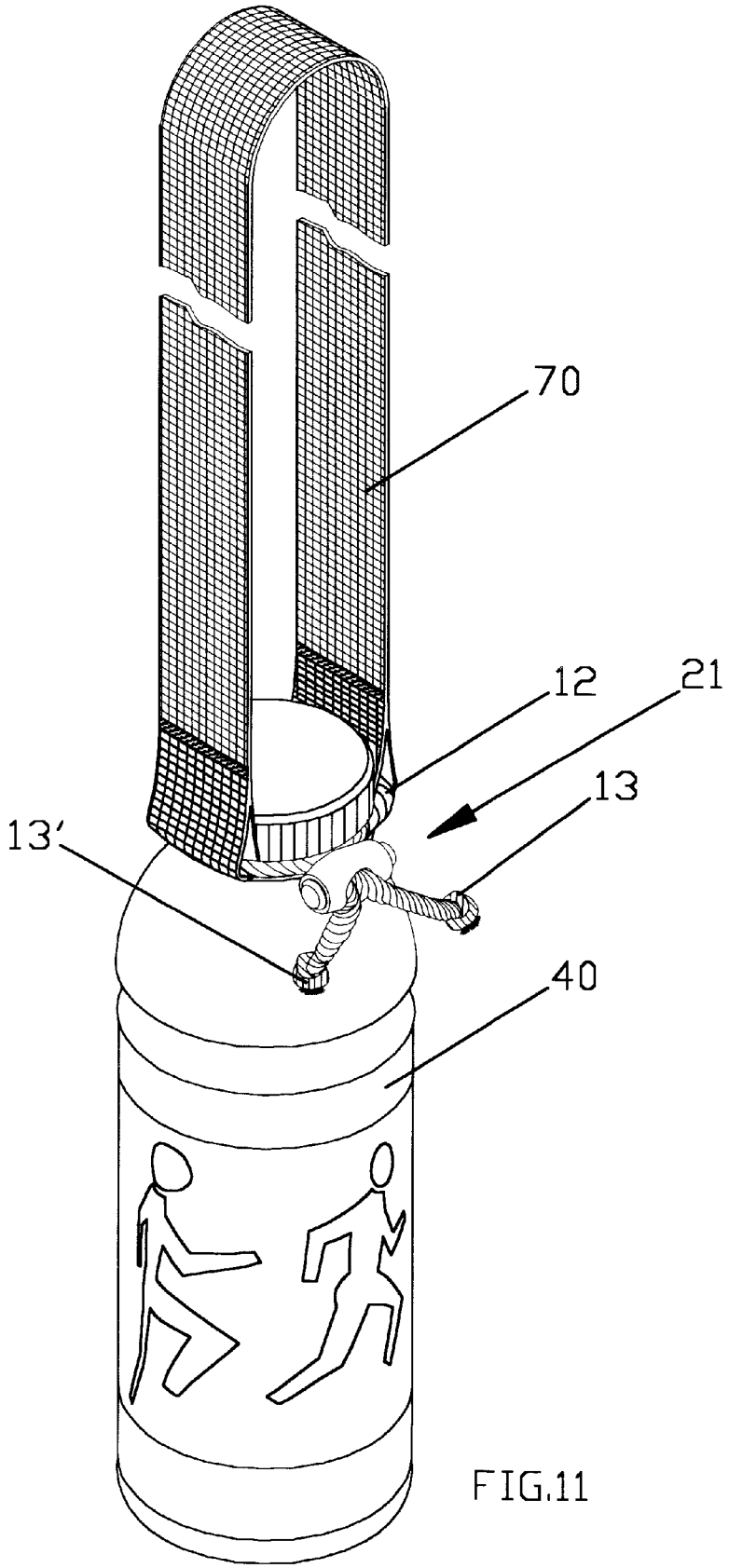
FIG. 11 is a a top perspective view of a bottle tote attached around a plastic container in accordance with the invention.

Referring to FIG. 11, the bottle tote 10 of FIGS. 7 and 8 is modified by removing the "J" clip and inserting the cord 12 into the loop formed by stitching 16, thereby forming a closed end "U" carrying handle.

Figure 10:
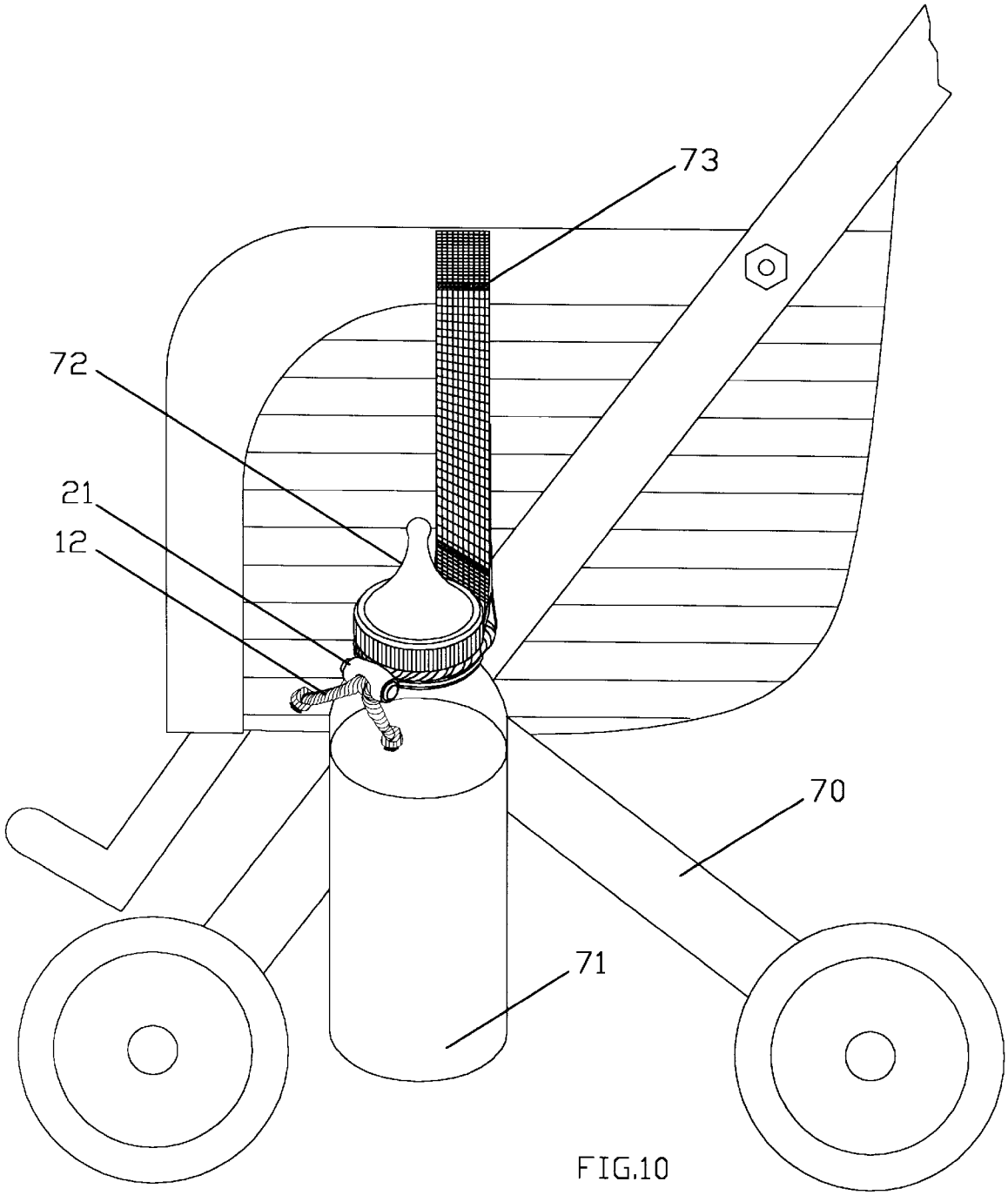
FIG. 10 is a top perspective view of a bottle tote fastened to a child's stroller in accordance with the invention.

Referring to FIG. 10, through the use of hook and loop pads 30, 31, (VELCRO), (FIG. 3) bottle tote 10 can be used to safely attach a baby's feeding bottle 71 to a stroller 70 where it is accessible to the child or parent and yet is kept from falling to the ground by accident or through the action of the child in discarding the bottle 71. This prevents contamination of the bottle 71 through contact with soiled surfaces.

Figure 9:
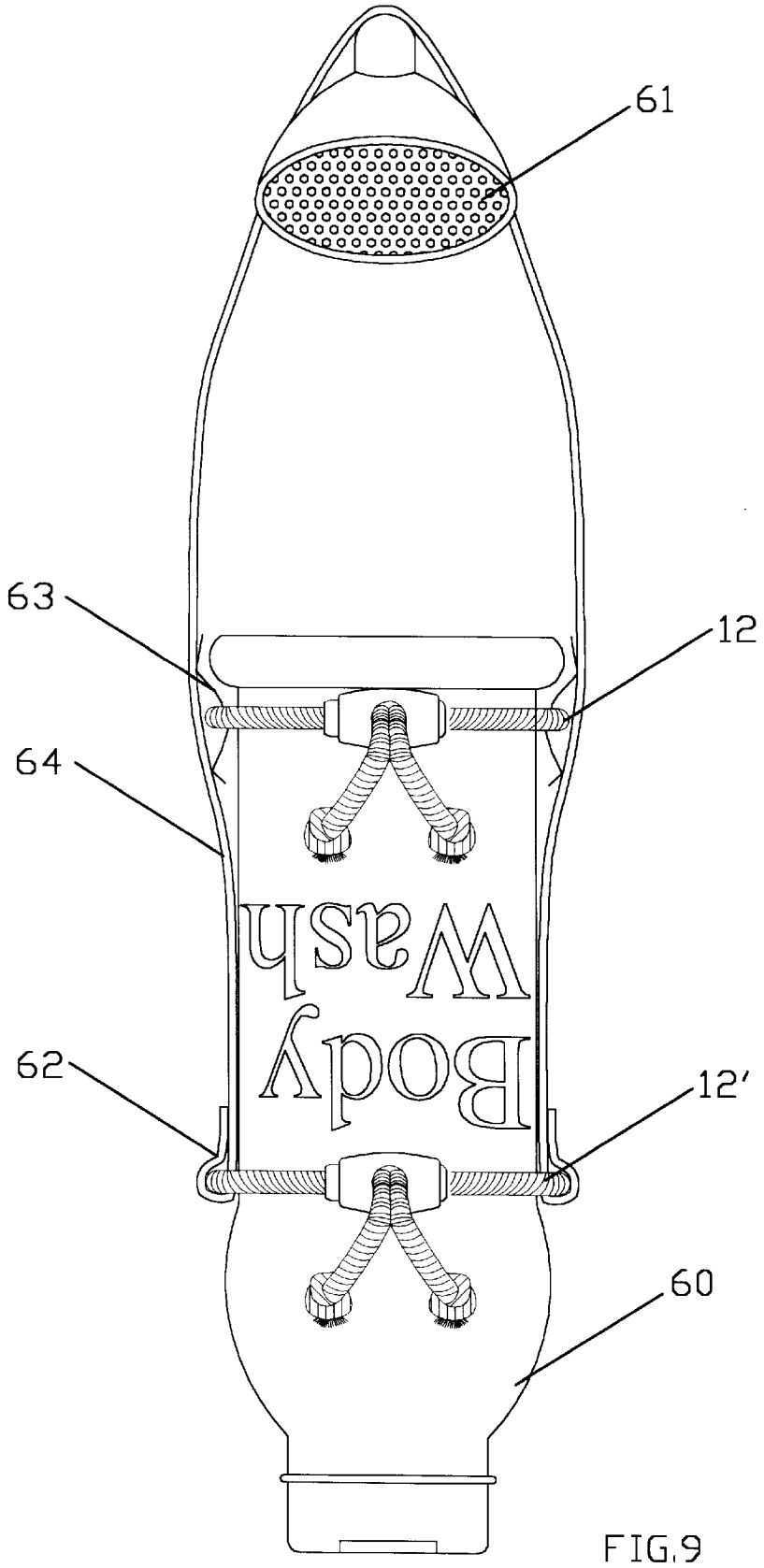
FIG. 9 is a front view of a fourth embodiment suspending a plastic bottle from a shower head in accordance with the invention.

Referring now to FIG. 9, shower soap container 60 is conveniently suspended from shower head 61. Nylon webbing belt 64 in this embodiment is used with double attachment points to suspend soap container 60 in a vertical position by fixing braided nylon cord 12 with tabs 63 at one end of soap container 60 and by fixing braided nylon cord 12 to the other end of the container 60 using looped attachment points 62. This embodiment of bottle tote 10 can easily be adapted to suspend the bottle 60 from the user's neck in an upright position, to be used as a drink container. This application allows the user to carry the container 60 without the use of the hands. In this manner, parents could easily and securely carry a child on one hip while the child is permitted to easily drink from the container 60.

One example of the embodiment shown in FIG. 1 utilized approximately 12" of webbing belt 14, one plastic "J" clip 33, "D" ring 15, and 9" of nylon cord 12. The "J" clip 33 was fastened to one end of the webbing belt 14. At the opposite end, a loop was formed and the cord 12 and the "D" ring were securely fastened with stitching.

In the example shown in FIG. 3, the webbing belt 14 was approximately 20" long, the nylon cord 12 was between 8" and 10" and the hook and loop tape 31, and 32 were 2½" long. The two parts of the hook and loop tape 30, and 31 were stitched to the upper quarter of the webbing belt 14 and the end of the belt 14 was stitched over with zig-zag stitching or a no fray product may be used to prevent fraying of the webbing belt 14. At the opposite end, a loop was formed and the cord 12 was securely fastened with stitching.

Figure 4:
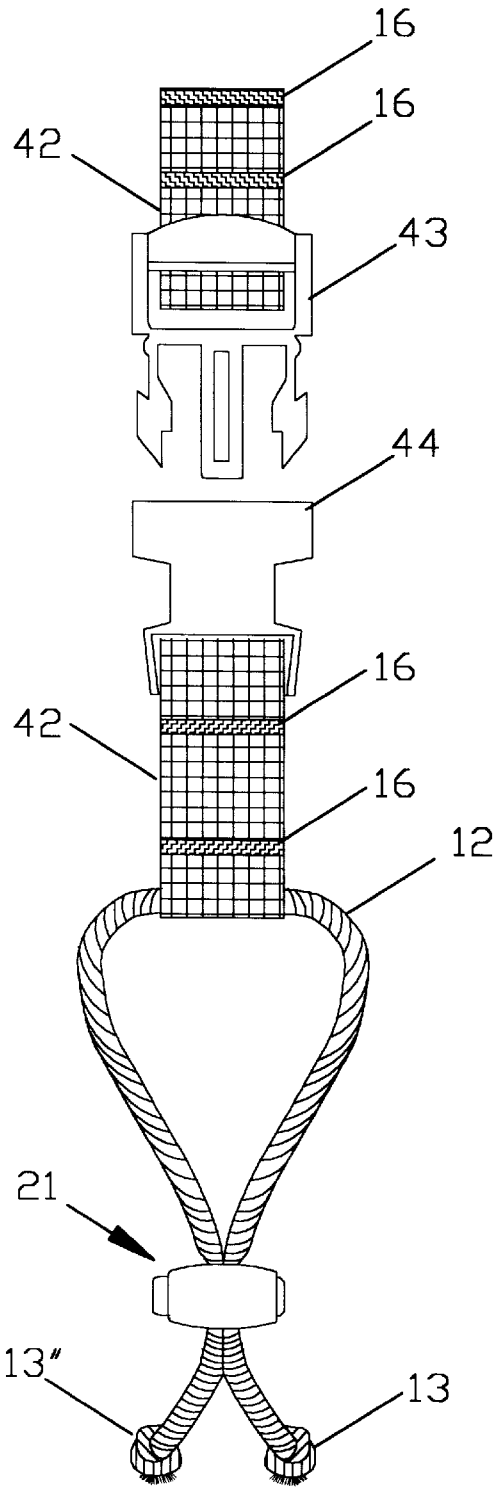
FIG. 4 is a front view of a third embodiment of a bottle tote in accordance with the invention.

In the example shown in FIGS. 4–6, plastic snap clips 43, and 44 were stitched to the top end of the webbing belt 14 and a short section of webbing belt 14 was fastened to snap clip 43 (the male portion) for attachment to the object selected to carry the bottle tote 10, such as, for example, the suitcase 50, or the backpack 51.

In operation, the user would generally fill a two liter plastic bottle of water, place the bottle in the freezer, and then withdraw the bottle of frozen water when ready for use. The user would then place the cord 12 over the bottle neck, and pull the cord 12 until the bottle is held snugly by the cord 12. The bottle 40, 41, or 60 is then ready to carry to the event.

While the invention has been explained with respect to a preferred embodiment thereof, it is contemplated that various changes may be made in the invention without departing from the spirit and scope thereof.

What is claimed is:

1. A device for carrying a bottle of liquid, said device comprising:

a nylon webbing having a first end and a second end, means for carrying said device formed on said first end, a loop formed on said second end, a braided nylon cord inserted through said loop formed in said second end of said webbing belt, said nylon cord having a first end and a second end, a spring loaded toggle clip slidably attached on said nylon cord over said first and second ends of said cord, thereby forming a loop for gripping a bottle between said loop formed on said second end of said nylon cord and said toggle clip, said toggle clip for adjusting the length of said loop for gripping a bottle for accommodating a range of bottleneck sizes and gripping said nylon cord in selected positions, and a knot formed on each of said first and second ends of said nylon cord for stopping said toggle clip, wherein said means for carrying said device being a "J" clip attached to said first end of said webbing and said braided nylon cord with said toggle clip and a "D" ring being attached to said loop formed on said second end of said webbing, whereby fastening said "J" clip and said "D" ring together forms a continuous loop for carrying the bottle.

* * * * *